US011038308B2

(12) United States Patent
Wei et al.

(10) Patent No.: US 11,038,308 B2
(45) Date of Patent: Jun. 15, 2021

(54) SHIELDING SHEET AND CONNECTOR HOUSING WITH THE SHIELDING SHEET

(71) Applicants: Tyco Electronics (Shanghai) Co. Ltd., Shanghai (CN); Tyco Electronics (Zhuhai) Ltd, Zhuhai (CN)

(72) Inventors: Jikang Wei, Zhuhai (CN); Hongwen Yang, Shanghai (CN); Shufeng Jia, Zhuhai (CN); Qiang Yu, Zhuhai (CN); Hongqiang Han, Shanghai (CN)

(73) Assignees: Tyco Electronics (Shanghai) Co. Ltd., Shanghai (CN); Tyco Electronics (Zhuhai) Ltd, Zhuhai (CN)

( * ) Notice: Subject to any disclaimer, the term of this patent is extended or adjusted under 35 U.S.C. 154(b) by 47 days.

(21) Appl. No.: 16/678,360

(22) Filed: Nov. 8, 2019

(65) Prior Publication Data

US 2020/0153170 A1 May 14, 2020

(30) Foreign Application Priority Data

Nov. 8, 2018 (CN) ..... 201811327833.3

(51) Int. Cl.

| | |
|---|---|
| ***H01R 9/03*** | (2006.01) |
| ***H01R 13/6592*** | (2011.01) |
| ***E06B 7/36*** | (2006.01) |
| ***H01R 13/46*** | (2006.01) |
| ***H01R 13/6582*** | (2011.01) |

(52) U.S. Cl.

CPC ..... *H01R 13/6592* (2013.01); *E06B 7/367* (2013.01); *H01R 13/46* (2013.01); *H01R 13/6582* (2013.01)

(58) Field of Classification Search

CPC ..... H01R 13/46; H01R 13/6582; H01R 13/6583; H01R 13/6592

USPC ..... 439/607.41, 607.48, 607.54

See application file for complete search history.

(56) References Cited

U.S. PATENT DOCUMENTS

| | | | | |
|---|---|---|---|---|
| 7,539,018 | B2 * | 5/2009 | Murr | H05K 7/20418 165/185 |
| 7,566,245 | B1 * | 7/2009 | McColloch | G02B 6/4201 439/607.2 |
| 7,857,662 | B2 * | 12/2010 | Gillespie | H01R 13/6582 439/607.3 |
| 8,033,741 | B2 * | 10/2011 | Yoshikawa | G02B 6/4201 385/92 |
| 2018/0358754 | A1 | 12/2018 | Wei et al. | |

* cited by examiner

*Primary Examiner* — Khiem M Nguyen
(74) *Attorney, Agent, or Firm* — Barley Snyder

(57) ABSTRACT

A connector housing includes a housing body having a socket adapted to receive an external electronic module inserted in an insertion direction and a shielding sheet having a first elastic sheet disposed on an inner side of the housing body, a second elastic sheet disposed on an outer side of the housing body, and a first bent portion connected between the first elastic sheet and the second elastic sheet and adapted to be clamped on an edge of the socket. The housing body has an outer wall with a mounting passageway. A free end of the first elastic sheet and/or the second elastic sheet has a pair of lap portions on a pair of sides parallel to the insertion direction. The free end of the first elastic sheet and/or the second elastic sheet is slidably engaged with the mounting passageway in the insertion direction.

22 Claims, 8 Drawing Sheets

SHIELDING SHEET AND CONNECTOR HOUSING WITH THE SHIELDING SHEET

CROSS-REFERENCE TO RELATED APPLICATION

This application claims the benefit of the filing date under 35 U.S.C. § 119(a)-(d) of Chinese Patent Application No. 201811327833.3, filed on Nov. 8, 2018.

FIELD OF THE INVENTION

The present invention relates to a shielding sheet and, more particularly, to a shielding sheet for a connector housing.

BACKGROUND

A shielding sheet on a periphery of a connector housing is commonly divided into two layers of inner and outer elastic sheet structure. The inner layer and outer layer elastic sheets are connected by an integral U-shaped bent structure. In addition, a tail of each claw of the inner layer elastic sheet is also designed into a U-shaped bent hook structure, and the shielding sheet is connected and fixed on a body of the connector housing by the U-shaped structures at a front end and a rear end of the shielding sheet.

Because the shielding sheets on the periphery of the connector housing are arranged closely, and the front end and the rear end are both U-shaped bent structures, there is not enough operation space for automatic assembly. Therefore, in the conventional manufacturing process, an operator generally manually assembles the two layer elastic sheet on the body of the connector housing, and then bends the shielding sheet on each surface by a mechanical tool to fix the shielding sheet on the body of the connector housing, thereby resulting in very low production efficiency. Moreover, the shielding sheets are easily deformed in the manual assembly process because the inner and outer layer elastic sheets are thin.

SUMMARY

A connector housing includes a housing body having a socket adapted to receive an external electronic module inserted in an insertion direction and a shielding sheet having a first elastic sheet disposed on an inner side of the housing body, a second elastic sheet disposed on an outer side of the housing body, and a first bent portion connected between the first elastic sheet and the second elastic sheet and adapted to be clamped on an edge of the socket. The housing body has an outer wall with a mounting passageway. A free end of the first elastic sheet and/or the second elastic sheet has a pair of lap portions on a pair of sides parallel to the insertion direction. The free end of the first elastic sheet and/or the second elastic sheet is slidably engaged with the mounting passageway in the insertion direction.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
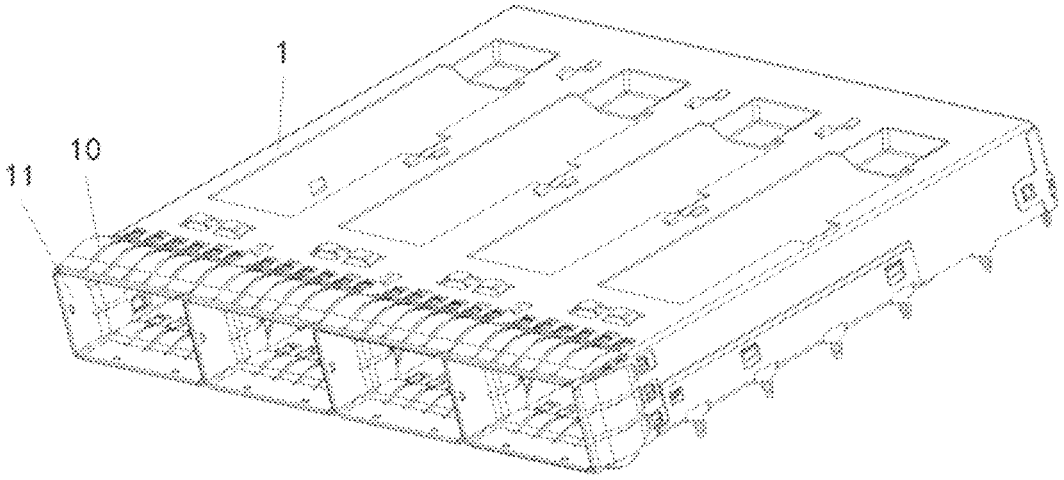
FIG. 1 is a perspective view of a connector housing according to an embodiment.

The present disclosure will be described hereinafter in further detail with reference to the following embodiments, taken in conjunction with the accompanying drawings. In the specification, the same or similar reference numerals indicate the same or similar parts. The description of the embodiments of the present disclosure with reference to the accompanying drawings is intended to explain the general inventive concept of the present disclosure, and should not be constructed as a limitation to the present disclosure.

In addition, in the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

A connector housing according to an embodiment, as shown in FIGS. 1-5, comprises a substantially rectangular-parallelepiped-shaped housing body 1 and a shielding sheet 10. The housing body 1 has a socket 11 adapted to receive an external electronic module inserted from an insertion direction. In various embodiments, the electronic module, for example, may be an electronic package structure, an optical-to-electrical converter, a disk reader, and the like suitable for an electrical equipment such as an electrical connector, a CPU, an amplifier, which may generate heat during operation.

As shown in FIGS. 2-5, a plurality of mounting passageways 12 is provided in an outer wall of the housing body 1. The shielding sheet 10 is made of a single sheet of metal material such as a copper sheet and has a first elastic sheet 101 provided on the inner side of the housing body 1, a second elastic sheet 102 provided on the outer side of the housing body 1, and a first bent portion 103 connected between the first elastic sheet 101 and the second elastic sheet 102 and adapted to be clamped on an edge of the socket 11. Lap portions 1011 are provided on two sides of a free end, a upper end in FIG. 4, of the first elastic sheet 101 parallel to the insertion direction. The free end of the first elastic sheet 101 is slidably engaged with the mounting passageway 12 in the insertion direction. The sliding engagement of the free end of the first elastic sheet 101 and the mounting passageway 12 may be realized by a structure in which the lap portions 1011 of the first elastic sheet 101 extends to the outer side of the housing body 1 through the mounting passageway 12. In an embodiment, the shielding sheet 10 is integrally formed from a single sheet of material by a machining process such as punching, bending, shearing, or the like.

In an embodiment, the lap portions 1011 are provided on two sides of a free end of the second elastic sheet 102 parallel to the insertion direction and the free end of the second elastic sheet 102 is slidably engaged with the mounting passageway 12 in the insertion direction. The sliding engagement of the free end of the second elastic sheet 102 and the mounting passageway 12 may be realized by a structure in which the lap portions 1011 of the second elastic sheet 102 extends to the inner side of the housing body 1 through the mounting passageway 12. In another embodiment, the lap portions 1011 are provided two sides of free ends of the first elastic sheet 101 and the second elastic sheet 102 parallel to the insertion direction and the free ends of the first elastic sheet 101 and the second elastic sheet 102 are slidably engaged with the mounting passageway 12 in the insertion direction. The sliding engagement of the free ends of the first elastic sheet 101 and the mounting passageway 12 may be realized by a structure in which the lap portions 1011 of the first elastic sheet 101 extends to the outer side of the housing body 1 through the mounting passageway 12; and the sliding engagement of the free end of the second elastic sheet 102 and the mounting passageway 12 may be realized by a structure in which the lap portions 1011 of the second elastic sheet 102 extends to the inner side of the housing body 1 through the mounting passageway 12.

Figure 2:
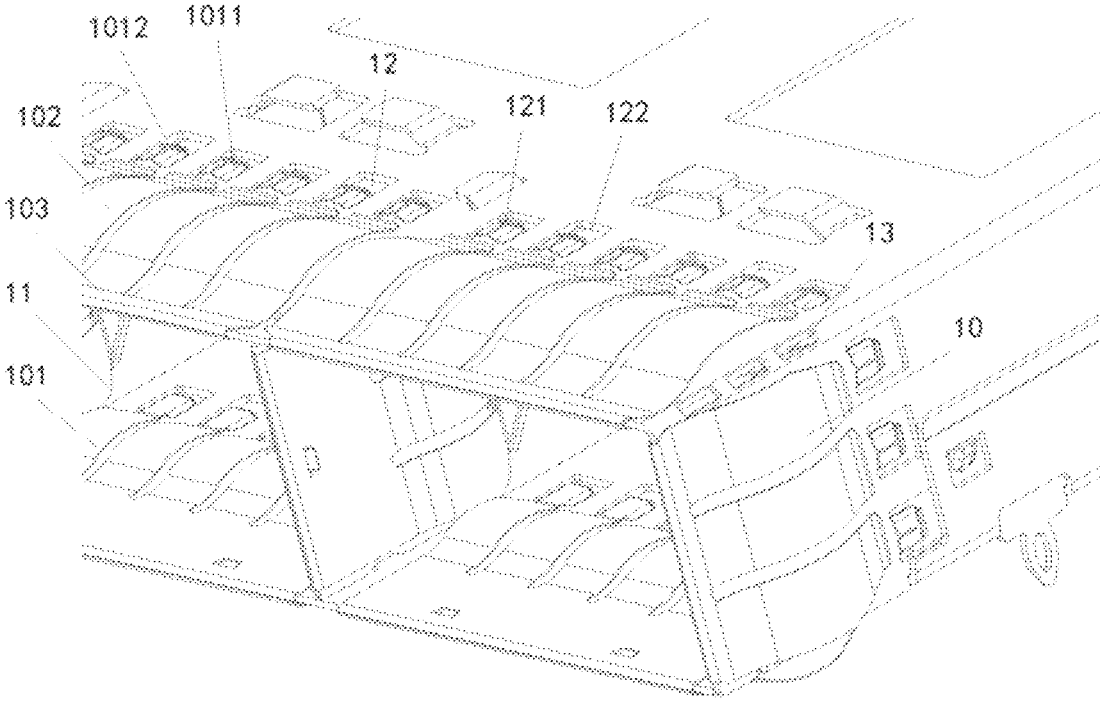
FIG. 2 is a perspective view of a socket of the connector housing of FIG. 1.
Figure 4:
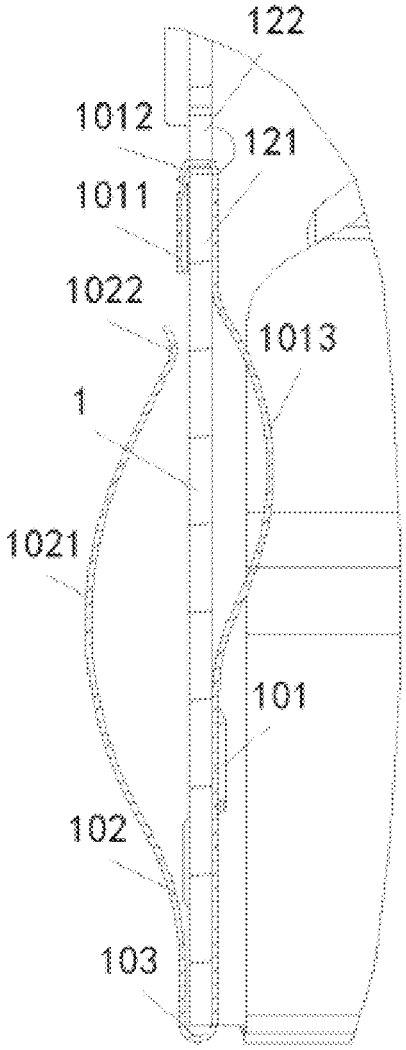
FIG. 4 is a sectional side view of the connector housing, taken along line A-A of FIG. 3.
Figure 5:
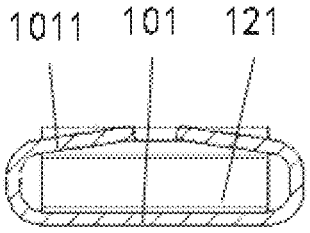
FIG. 5 is a sectional end view of a lap portion and a support arm of the connector housing of FIG. 4.

As shown in FIGS. 2, 4 and 5, a support arm 121 extending in the insertion direction is provided in the mounting passageway 12, and at least one of a pair of ends of the support arm 121 is integrally connected to at least one of a pair of opposite edges of the mounting passageway 12 in the insertion direction. A length of the support arm 121 is equal to or less than that of the mounting passageway 12. A width of the support arm 121 is smaller than that of the mounting passageway 12. The mounting passageway 12 may be formed as a rectangular passageway, and the support arm 121 formed as a rectangular plate. A center line of the support arm 121 is coincided with a center line of the mounting passageway 12 to form a symmetrical structure, such that distances from both sides of the support arm 121 parallel to the insertion direction to both edges of the mounting passageway 12 parallel to the insertion direction, respectively, are equal to each other. The lap portions 1011 may be more easily and reliably engaged with the mounting passageway 12 in a slide manner by providing the support arm 121.

As shown in FIGS. 2-5, the lap portions 1011 are bent from the inner side of the support arm 121 to the outer side of the support arm 121 such that the free end of the first elastic sheet 101 is slidably engaged with the support arm 121. The lap portions 1011 are symmetrically provided on the two sides of the free end of the first elastic sheet 101. Each of the lap portions 1011 is formed as a substantially L-shaped structure, and the symmetrical lap portions 1011 extend toward each other. In the shown embodiment, the two symmetrical lap portions 1011 are formed as a structure with a short leg of the L-shape of each of the lap portions 1011 facing each other. In this way, the lap portions 1011 on the two sides of the free end of the first elastic sheet 101 are clasped on the support arm 121, and a distance between the inner side of the lap portions 1011 and the inner side of the free end of the first elastic sheet 101 is greater than a thickness of the support arm 121, so that the lap portions 1011 and the support arm 121 are slidably engaged. The lap portions 1011 ensure that the shielding sheet 10 may slide forward and backward within a limited section in the insertion direction, and also prevents the shielding sheet 10 from being displaced in a left-right direction, a left-right direction in FIG. 3, and in an up-down direction, an up-down direction in FIG. 5. In this way, a mold may be used to adjust a relative position of the shielding sheet 10 and the housing body 1 as necessary while ensuring the assembly accuracy during processing.

In another embodiment, shown in FIGS. 6-11, the lap portions 1011 are bent from the inner side of the support arm 121 to outer sides of two side edges of the mounting passageway 12 parallel to the insertion direction, so that the free end of the first elastic sheet 101 is slidably engaged with the side edges. In this configuration, the width of the supporting arm 12 is less than or equal to that of the first elastic sheet 101, so as to avoid unnecessary excessive bending of the lap portions 1011. The lap portions 1011 are symmetrically provided on two sides of the free end of the first elastic sheet 101. Each of the lap portions 1011 is formed as a generally L-shaped structure, and the symmetrical lap portions 1011 extend in directions away from each other. In the shown embodiment, the two symmetrical lap portions 1011 are formed as a structure with a short leg of the L-shape of each of the lap portions 1011 facing away from each other to ensure that the lap portions 1011 are smoothly engaged with the mounting passageway 12 in a slide manner and lapped onto the two side edges of the mounting passageway 12 parallel to the insertion direction, so that the first elastic sheet 101 is relatively balanced in force.

As shown in FIGS. 2, 4, 7 and 9, the support arm 121 extends from a proximal edge of the mounting passageway 12 close to the socket 11 toward a distal edge of the mounting passageway 12 away from the socket 11, and a gap 122 is provided between a free end of the support arm 121 and the distal edge of the mounting passageway 12 away from the socket 11. The gap 122 is provided so that a mold for assembling the connector housing may have larger operation space when the automatic assembly is performed, thereby reducing the difficulty of the mold operation.

As shown in FIGS. 2, 4, 7 and 9, an edge of the free end of the first elastic sheet 101 perpendicular to the insertion direction has an auxiliary lap portion 1012 which is bent from the inner side of the support arm 121 to the outer side of the support arm 121 through the gap 122 in order to further improve the connection reliability and positioning accuracy of the first elastic sheet 101 and the housing body 1 during the processing. The auxiliary lap portion 1012 may be formed as an arc-shaped structure. In various embodiments, a length of the auxiliary lap portion 1012 bent to the outside of the support arm 121 ranges from 0.1 mm to 0.15 mm. The auxiliary lap portion 1012 has a sufficient length to lap onto the support arm 121, yet the length of the auxiliary lap portion 1012 is not too long to interfere with the lap portions 1011. The mounting passageway 12 is formed at a position of the housing body 1 away from the free end of the second elastic sheet 102 with respect to the socket 11, so that the lap portions 1011 of the first elastic sheet 101 protruding from the mounting passageway 12 out of the housing body 1 does not interfere with the sliding of the free end of the second elastic sheet 102 in the insertion direction.

Figure 9:
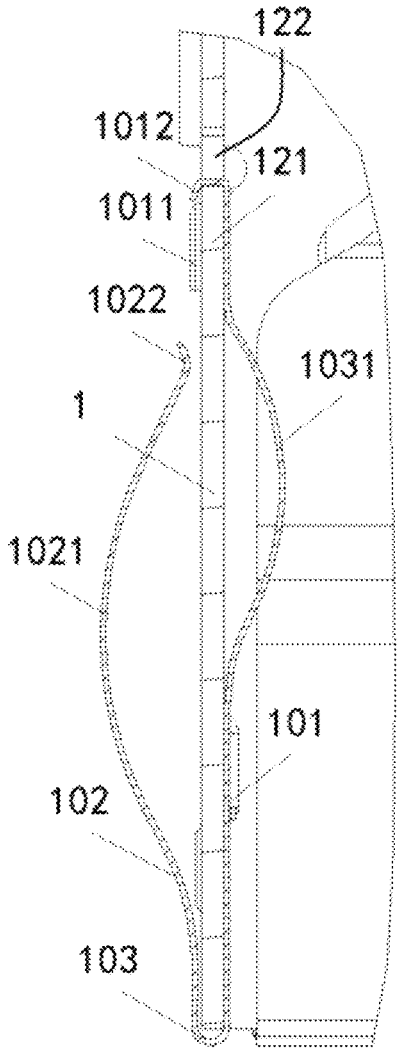
FIG. 9 is a sectional side view of the connector housing, taken along line B-B of FIG. 8.

As shown in FIGS. 4 and 9, the first elastic sheet 101 has a first elastic contact portion 1013 protruding away from the inner wall of the housing body 1 between the first bent portion 103 and the free end of the first elastic sheet 101, and the second elastic sheet 102 has a second elastic contact portion 1021 protruding away from the outer wall of the housing body 1 between the first bent portion 103 and the free end of the second elastic sheet 102. In the shown embodiment, the first elastic contact part 1013 and the second elastic contact part 1021 are arc-shaped and protrude in upward and downward directions, respectively.

As shown in FIGS. 4 and 9, the free end of the second elastic sheet 102 has a third elastic contact part 1022 protruding toward the outer wall of the housing body 1. The third elastic contact part 1022, in an embodiment, is formed as an arc structure. The third elastic contact portion 1022 may play a role of guiding in the process of mounting the shielding sheet 10 on the housing body 1, and at the same time, may also increase a contact point of the shielding sheet 10 and the housing body 1, thereby increasing the contact area.

Figure 7:
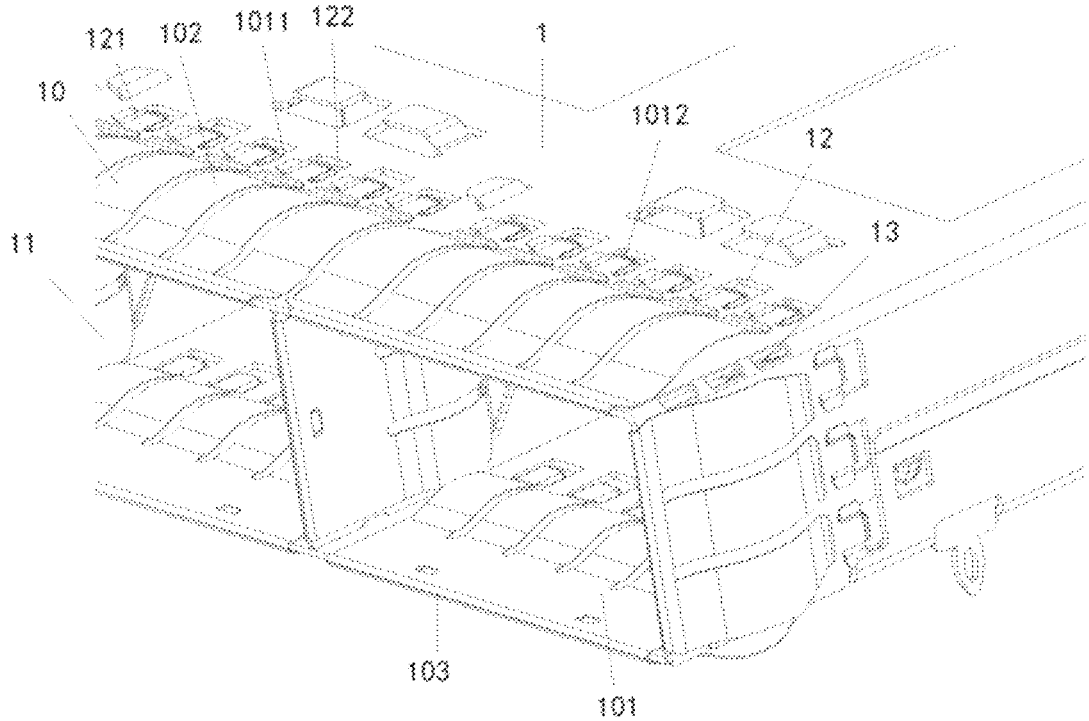
FIG. 7 is a perspective view of a socket of the connector housing of FIG. 6.

As shown in FIGS. 2 and 7, at least one corner passageway 13 extending in the insertion direction is provided at a corner of the housing body 1. The corner passageway 13 may be adapted to receive a portion of an edge of two adjacent sub-elastic sheets of the first elastic sheet 101 located at the corner. The corner passageway 13 may also reduce a force required for bending during bending the housing body 1. A plurality of corner passageways 13 are provided at each corner of the housing body 1, and in the embodiment shown in FIGS. 2 and 7, each corner of the housing body 1 is provided with three corner passageways 13.

The shielding sheet 10 according to an embodiment includes a first elastic sheet 101, a second elastic sheet 102, and a first bent portion 103 provided between the first elastic sheet 101 and the second elastic sheet 102 and adapted to be clamped on the edge of the socket 11 of the connector housing; lap portions 1011 are provided on the two sides of the free end(s) of the first elastic sheet 101 and/or the second elastic sheet 102 parallel to a length direction of the first elastic sheet 101, and the free end of the first elastic sheet 101 and/or the second elastic sheet 102 are/is slidably engaged with the mounting passageway 12 in the length direction of the first elastic sheet 101. In the embodiments shown in FIGS. 2 and 7, the shielding sheet 10 has a plurality of first elastic sheets 101 and a plurality of second elastic sheets 102, so that the shielding sheet 10 has a more flexible structure and clamping on while having enough contact area with the housing body 1. In addition, the lap portions 1011 are symmetrically provided on the two sides of the free end of the first elastic sheet 101.

In an embodiment, the two sides of the free ends of the first elastic sheet 101 and the second elastic sheet 102 parallel to the length direction of the first elastic sheet 101 have the lap portions 1011, and the free ends of the first elastic sheet 101 and the second elastic sheet 102 are slidably engaged with the mounting passageway 12 in the length direction of the first elastic sheet 101. The sliding engagement of the first elastic sheet 101 and the second elastic sheet 102 with the mounting passageway 12 may be realized by a structure in which the lap portions 1011 of the first elastic sheet 101 and the second elastic sheet 102 extends from one side of the housing body 1 to the other side of the housing body 1 through the mounting passageway 12 of the housing body 1.

In another embodiment, only two sides of the free end of the first elastic sheet 101 parallel to the length direction of the first elastic sheet 101 are provided with lap portions 1011, and the free end of the first elastic sheet 101 is slidably engaged with the mounting passageway 12 in the length direction of the first elastic sheet 101. The sliding engagement of the first elastic sheet 101 and the mounting passageway 12 may be realized by a structure in which the lap portions 1011 of the first elastic sheet 101 extends from the inside of the housing body 1 to the outside of the housing body 1 through the mounting passageway 12 of the housing body 1.

In still another embodiment, only two sides of the free end of the second elastic sheet 102 parallel to the length direction of the first elastic sheet 101 are provided with lap portions 1011, and the free end of the second elastic sheet 102 is slidably engaged with the mounting passageway 12 in the length direction of the first elastic sheet 101. The sliding engagement of the second elastic sheet 102 and the mounting passageway 12 may be realized by a structure in which the lap portions 1011 of the second elastic sheet 102 extends from the outside of the housing body 1 to the inside of the housing body 1 through the mounting passageway 12 of the housing body 1.

Figure 3:
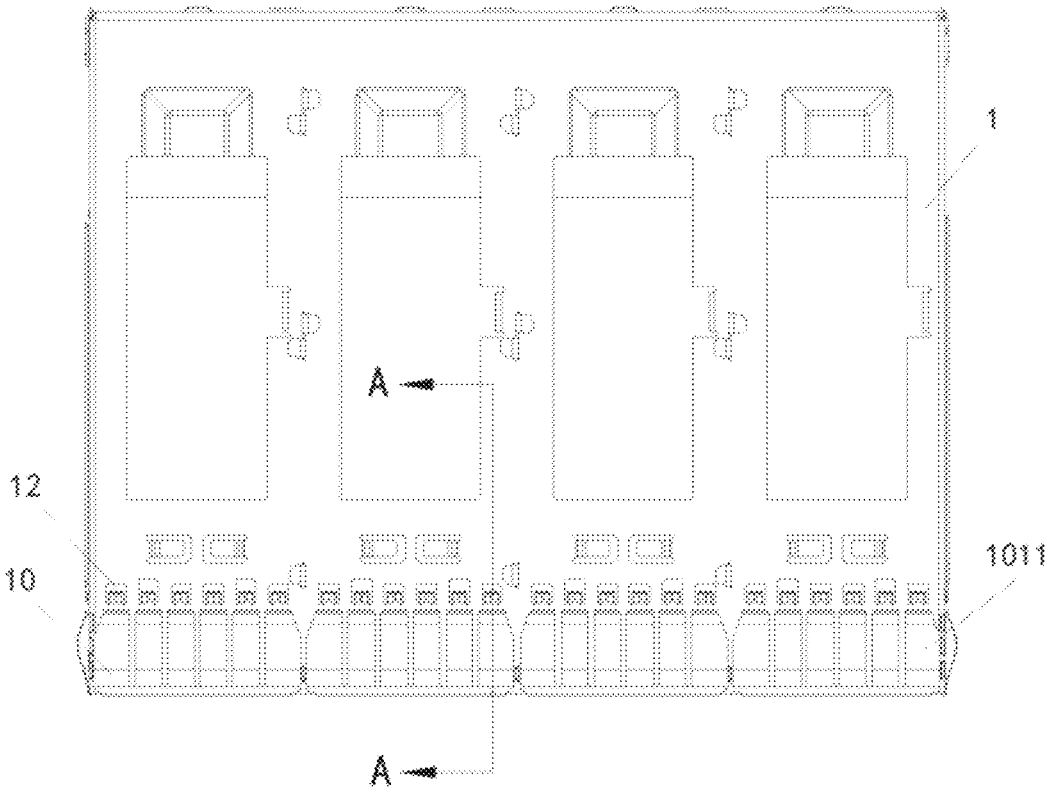
FIG. 3 is a top view of the connector housing of FIG. 1.

As shown in FIGS. 2, 3 and 5, the lap portions 1011 on two sides of the free end of the first elastic sheet 101 are bent toward each other in the width direction of the first elastic sheet 101 to form a shape with a short leg of the L-shape of each of the lap portions 1011 facing toward each other. In an embodiment, the lap portions 1011 are symmetrically provided on the two sides of the free end of the first elastic sheet 101, each of the lap portions 1011 is formed as a substantially L-shaped structure, and the symmetrical lap portions 1011 extend toward each other. More specifically, the two symmetrical lap portions 1011 together form a structure with the short leg of the L-shape of each of the lap portions 1011 facing toward each other. The first elastic sheet 101 with this structure and the lap portions 1011 on the two sides of the free end thereof is formed as an open ring structure, and may be more firmly connected to the housing body 1.

Figure 8:
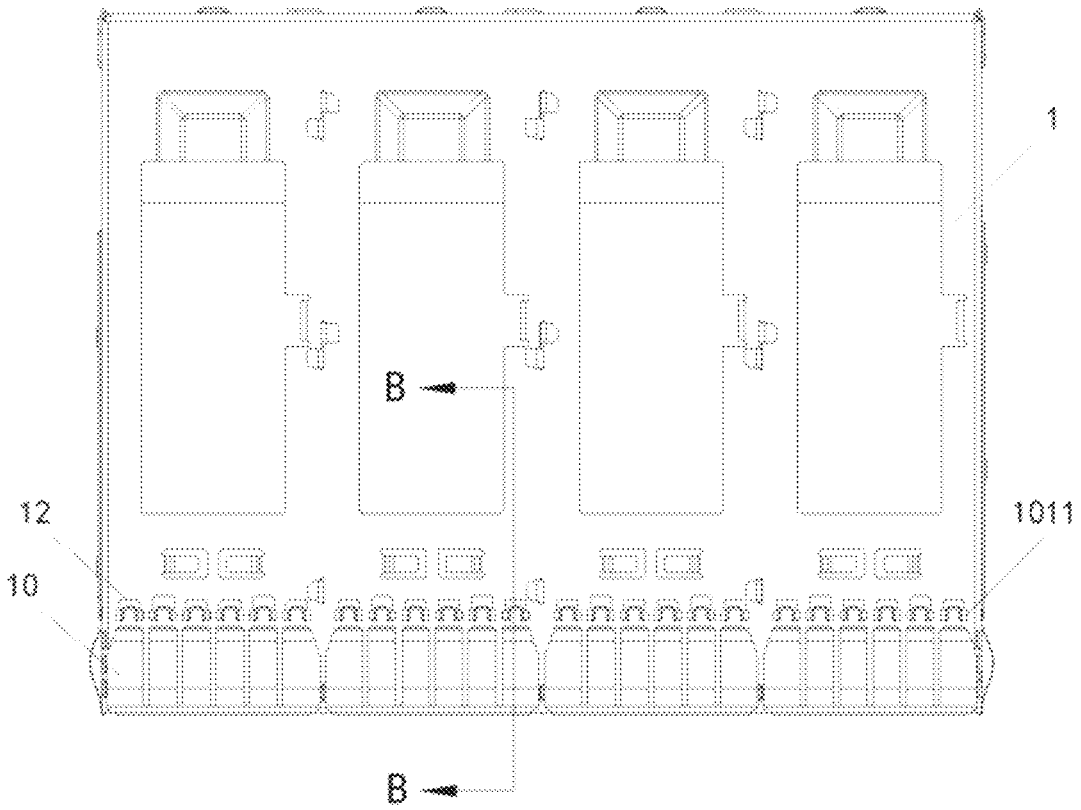
FIG. 8 is a top view of the connector housing of FIG. 6.
Figure 10:
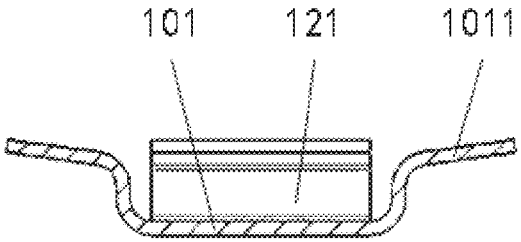
FIG. 10 is a sectional end view of a lap portion and a support arm of the connector housing of FIG. 9.

As shown in FIGS. 7, 8 and 10, the lap portions 1011 on the two sides of the free end of the first elastic sheet 101 are bent away from each other in the width direction of the first elastic sheet 101 to form a shape with a short leg of the L-shape of each of the lap portions 1011 facing away from each other. In an embodiment, the lap portions 1011 are symmetrically provided on the two sides of the free end of the first elastic sheet 101. Each of the lap portions 1011 is formed as a generally L-shaped structure and the symmetrical laps 1011 extending in directions away from each other. More specifically, the two symmetrical lap portions 1011 are formed as a structure with a short leg of the L-shape of each of the lap portions 1011 facing away from each other.

As shown in FIGS. 4 and 9, an edge of the free end of the first elastic sheet 101 parallel to the width direction of the first elastic sheet 101 has an auxiliary lap portion 1012 bent toward the socket 11 in the length direction of the first elastic sheet 101. The auxiliary lap portion 1012 may be formed as an arc-shaped structure. The first elastic sheet 101 has a first elastic contact portion 1013 between the first bent portion 103 and the free end of the first elastic sheet 101, and the second elastic sheet 102 has a second elastic contact portion 1021 between the first bent portion 103 and the free end of the second elastic sheet 102. The first elastic contact portion 1013 and the second elastic contact portion 1021 are both arc-shaped and protrude in opposite directions.

As shown in FIGS. 4 and 9, the free end of the second elastic sheet 102 has a third elastic contact portion 1022, and the third elastic contact portion 1022 and the second elastic contact portion 1021 protrude in opposite directions. The third elastic contact portion 1022 may be an arc-shaped structure.

Figure 6:
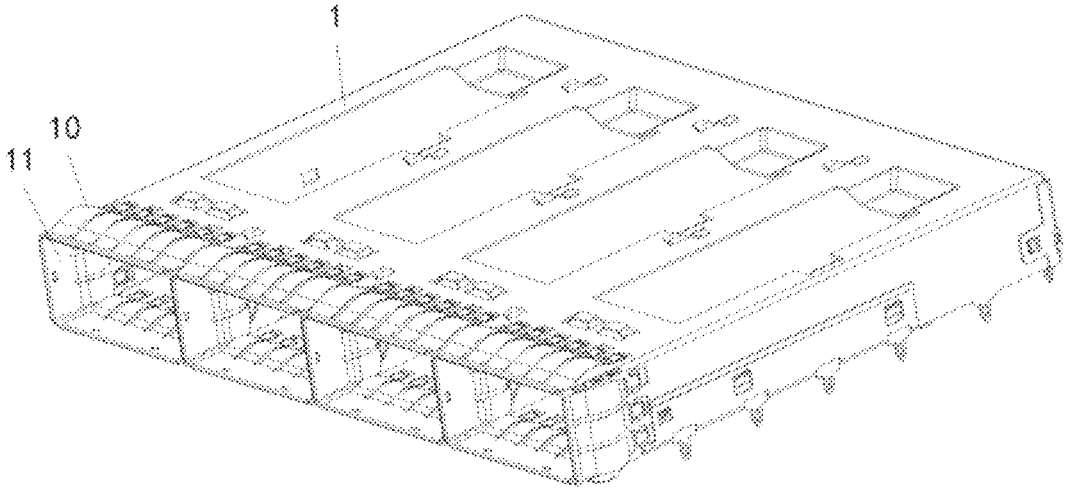
FIG. 6 is a perspective view of a connector housing according to another embodiment.
Figure 11:
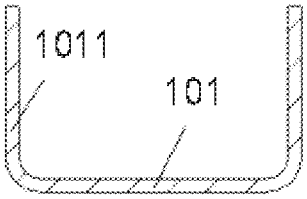
FIG. 11 is a sectional end view of a lap portion of a first elastic sheet before bending.

FIG. 11 shows a schematic view of a lap portion of a first elastic sheet shown in FIGS. 5 and 10 before being bent. In the process of manufacturing the connector housing, when the lap portion 1011 of the first elastic sheet 101 is in the state shown in FIG. 11, the remaining portion of the first elastic sheet 101 that is not bent may be attached to the housing body 1 that is not bent, and the lap portion 1011 in the state shown in FIG. 11 may be passed from one side to the other side of the housing body 1 through the mounting passageway 12. The lap portion 1011 is bent in a direction perpendicular to the insertion direction by a mold so that the lap portion 1011 is slidably engaged with the mounting passageway 12 in the insertion direction. Then, the auxiliary lap portion 1012 is bent by the mold, and the first elastic contact portion 1013, the second elastic contact portion 1021, and the third elastic contact portion 1022 of the shielding sheet 10 and the corner passageway 13 of the housing body 1 are processed. After the shielding sheet 10 and the housing body 1 are processed, they are synchronously bent in a direction perpendicular to the insertion direction, so that the substantially rectangular-parallelepiped-shape housing body 1 and the shielding sheet 10 as shown in FIGS. 1 and 6 are manufactured.

Figure 12:
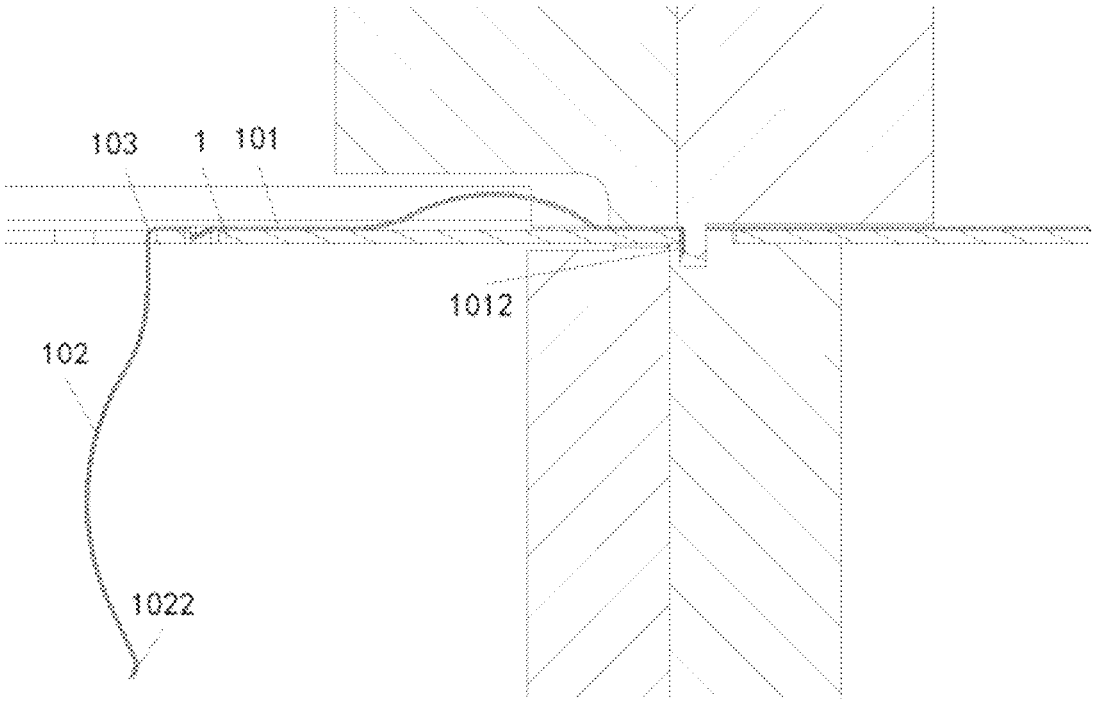
FIG. 12 is a sectional side view of an automatic assembly of a housing body and shielding sheet according to an embodiment.

Automatic assembly of a housing body 1 and a shielding sheet 10 according to an embodiment is shown in FIG. 12. As shown in FIG. 12, in the process of machining, the lap portion 1011 of the first elastic sheet 101 is automatically bent in the direction perpendicular to the insertion direction by the mold to form a structure shown in FIGS. 5 and 10. The shielding sheet 10 is formed as a structure suspended on the housing body 1 and sliding back and forth along the housing body 1 in the insertion direction, so as to ensure that the first elastic sheet 101 may slide back and forth in the insertion direction within a limited section, thereby reserving an operation space for automatic assembly of the connector housing. The shielding sheet 10 and the housing body 1 of the connector housing may be suitable for automatic assembly, improving the assembly accuracy and efficiency of the shielding sheet 10 and the connector housing.

It should be appreciated by those skilled in this art that the above embodiments are intended to be illustrative, and many modifications may be made to the above embodiments by those skilled in this art, and various structures described in various embodiments may be freely combined with each other without conflicting in configuration or principle.

Although the present disclosure have been described hereinbefore in detail with reference to the attached drawings, it should be appreciated that the disclosed embodiments in the attached drawings are intended to illustrate embodiments of the present disclosure by way of example, and should not be construed as limitation to the present disclosure.

Although several exemplary embodiments have been shown and described, it would be appreciated by those skilled in the art that various changes or modifications may be made to these embodiments without departing from the principles and spirit of the disclosure, the scope of which is defined by the claims and their equivalents.

What is claimed is:

1. A connector housing, comprising:

a housing body having a socket adapted to receive an external electronic module inserted in an insertion direction, the housing body having an outer wall with a mounting passageway; and a shielding sheet having a first elastic sheet disposed on an inner side of the housing body, a second elastic sheet disposed on an outer side of the housing body, and a first bent portion connected between the first elastic sheet and the second elastic sheet and adapted to be clamped on an edge of the socket, a free end of the first elastic sheet and/or the second elastic sheet has a pair of lap portions on a pair of sides parallel to the insertion direction, the free end of the first elastic sheet and/or the second elastic sheet is slidably engaged with the mounting passageway in the insertion direction.

2. The connector housing of claim 1, wherein the free end of the first elastic sheet has the lap portions and is slidably engaged with the mounting passageway.

3. The connector housing of claim 1, wherein the housing body has a support arm extending in the insertion direction and disposed in the mounting passageway, an end of the support arm is integrally connected to an edge of the mounting passageway.

4. The connector housing of claim 3, wherein each lap portion is bent from an inner side of the support arm to an outer side of the support arm, the free end of the first elastic sheet and/or the second elastic sheet is slidably engaged with the support arm.

5. The connector housing of claim 3, wherein each lap portion is bent from an inner side of the support arm to an outer side of a side edge of the mounting passageway, the side edge extending parallel to the insertion direction, the free end of the first elastic sheet and/or the second elastic sheet is slidably engaged with the side edge.

6. The connector housing of claim 3, wherein the support arm extends from a proximal edge of the mounting passageway adjacent the socket toward a distal edge of the mounting passageway away from the socket, a gap is disposed between a free end of the support arm and the distal edge of the mounting passageway.

7. The connector housing of claim 6, wherein the free end of the first elastic sheet has an auxiliary lap portion extending perpendicular to the insertion direction, the auxiliary lap portion is bent from an inner side of the support arm to an outer side of the support arm through the gap.

8. The connector housing of claim 7, wherein a length of the auxiliary lap portion is between 0.1 mm and 0.15 mm.

9. The connector housing of claim 1, wherein the mounting passageway is spaced apart from the free end of the second elastic sheet in the insertion direction.

10. The connector housing of claim 1, wherein the first elastic sheet has a first elastic contact portion extending away from an inner wall of the housing body between the first bent portion and the free end of the first elastic sheet, and the second elastic sheet has a second elastic contact portion extending away from the outer wall of the housing body between the first bent portion and the free end of the second elastic sheet.

11. The connector housing of claim 10, wherein the free end of the second elastic sheet has a third elastic contact portion extending toward the outer wall of the housing body.

12. The connector housing of claim 1, wherein the shielding sheet is integrally formed of a single sheet of material.

13. The connector housing of claim 12, wherein the housing body has a corner passageway extending in the insertion direction at a corner of the housing body.

14. A shielding sheet, comprising:

a first elastic sheet;

a second elastic sheet; and a first bent portion between the first elastic sheet and the second elastic sheet and adapted to be clamped on an edge of a socket of a connector housing, a free end of the first elastic sheet and/or the second elastic sheet has a pair of lap portions on a pair of sides parallel to a length direction of the first elastic sheet, the free end of the first elastic sheet and/or the second elastic sheet is slidably engaged with a mounting passageway in the length direction.

15. The shielding sheet of claim 14, wherein the free end of the first elastic sheet has the lap portions and is slidably engaged with the mounting passageway.

16. The shielding sheet of claim 14, wherein each of the lap portions has an L-shape.

17. The shielding sheet of claim 16, wherein the lap portions are bent away from each other in a width direction of the first elastic sheet, with a short leg of the L-shape of each of the lap portions facing away from other.

18. The shielding sheet of claim 16, wherein the lap portions are bent toward each other in a width direction of the first elastic sheet, with a short leg of the L-shape of each of the lap portions facing toward other.

19. The shielding sheet of claim 14, wherein the free end of the first elastic sheet has an auxiliary lap portion parallel to a width direction of the first elastic sheet, the auxiliary lap portion is bent toward the socket in the length direction of the first elastic sheet.

20. The shielding sheet of claim 14, wherein the first elastic sheet has a first elastic contact portion between the first bent portion and the free end of the first elastic sheet, the second elastic sheet has a second elastic contact portion between the first bent portion and the free end of the second elastic sheet, and the first elastic contact portion and the second elastic contact portion are arc-shaped and protrude in opposite directions.

21. The shielding sheet of claim 20, wherein the free end of the second elastic sheet has a third elastic contact portion, the third elastic contact portion and the second elastic contact portion protrude in opposite directions.

22. The shielding sheet of claim 14, wherein the shielding sheet is integrally formed of a single sheet of material.

* * * * *